313-422 SR
5/18/82 OR 4,330,735

United States Patent [19]
Leedom

[11] 4,330,735
[45] May 18, 1982

[54] BEAM GUIDE STRUCTURE FOR A FLAT PANEL DISPLAY DEVICE

[75] Inventor: Marvin A. Leedom, Princeton, N.J.

[73] Assignee: RCA Corporation, New York, N.Y.

[21] Appl. No.: 125,822

[22] Filed: Feb. 29, 1980

[51] Int. Cl.[3] ..... H01J 29/02
[52] U.S. Cl. ..... 313/422; 313/438
[58] Field of Search ..... 313/417, 422, 438

[56] References Cited

U.S. PATENT DOCUMENTS 4,049,991 9/1977 Collins ..... 313/417
4,101,802 7/1978 Andreuski ..... 313/422

*Primary Examiner*—Eli Lieberman
*Attorney, Agent, or Firm*—Eugene M. Whitacre; Glenn H. Bruestle; Lester L. Hallacher

[57] ABSTRACT

A beam guide assembly for a flat panel display device includes a plurality of meshes arranged in a spaced parallel relationship. Insulative supports permanently retain the meshes in the spaced relationship. The supports preferably comprises glass rods or beads spaced along the length of the assembly with portions of the meshes embedded therein. The beads are transversely displaced to allow beads of adjacent assemblies to be interleaved in a common aligned column. The beam guide assemblies can readily be fabricated and assembled using automatic and mass production techniques.

8 Claims, 4 Drawing Figures

BEAM GUIDE STRUCTURE FOR A FLAT PANEL DISPLAY DEVICE

BACKGROUND OF THE INVENTION

This invention relates generally to flat panel display devices and particularly to a beam guide structure for such devices.

U.S. Pat. No. 4,088,920 discloses a flat panel display device which includes a beam guide structure. The display device includes an evacuated envelope having front and back walls and a plurality of sidewalls which hold the front and back walls in a spaced parallel relationship. A plurality of support vanes are arranged perpendicular to the front and back walls to support the walls against atmospheric pressure and to divide the display device into a plurality of longitudinal channels along which electron beams are propagated. The support vanes contain two parallel longitudinal grooves which support beam guide meshes. The support grooves are spaced so that the beam guide meshes are held in a spaced and parallel relationship and electron beams are propagated along the lengths of the channels in the space between the guide meshes. A beam guide structure constructed in the manner disclosed in this patent is operationally satisfactory but is disadvantageous because the structure cannot be produced using automatic or mass assembly techniques.

U.S. Pat. No. 4,101,802 discloses a flat panel display device of the general type described in the above patent. The display device includes beam guide assemblies composed of two guide meshes held in a spaced parallel relationship by metal spacers inserted between the guide meshes. The beam guide assemblies also include a focus mesh and an acceleration mesh which are supported parallel to the guide meshes by nonconductive spacers. A beam guide assembly constructed in the manner disclosed in this patent is operationally satisfactory, but is disadvantageous because the structure cannot be assembled utilizing automatic or mass assembly techniques.

SUMMARY OF THE INVENTION

A beam guide assembly includes two beam guide meshes which are arranged in a spaced and parallel relationship. A focus mesh and an acceleration mesh also are arranged parallel to and spaced from the beam guide meshes. The spaced parallel relationship of the meshes is permanently retained by a plurality of insulator members to which the meshes are fixed. The beam guide assemblies, therefore, can be automatically fabricated as separate units and incorporated into a flat panel display device using mass production techniques.

FIG. *2a* shows the details of the tabs which hold the glass beads to the meshes.

Figure 2:
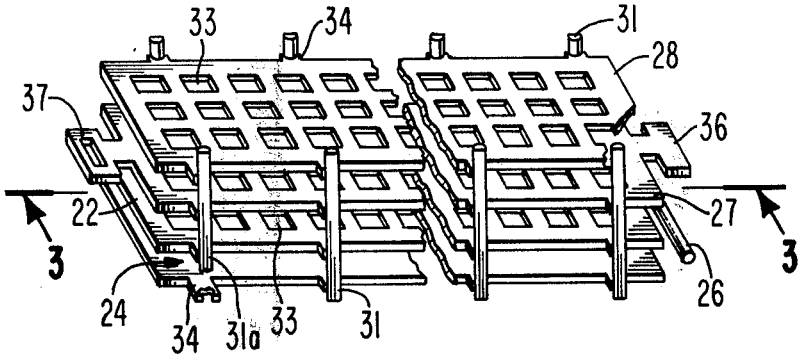
FIG. 2 is a perspective view, partially broken away, of a preferred embodiment.
Figure 3:
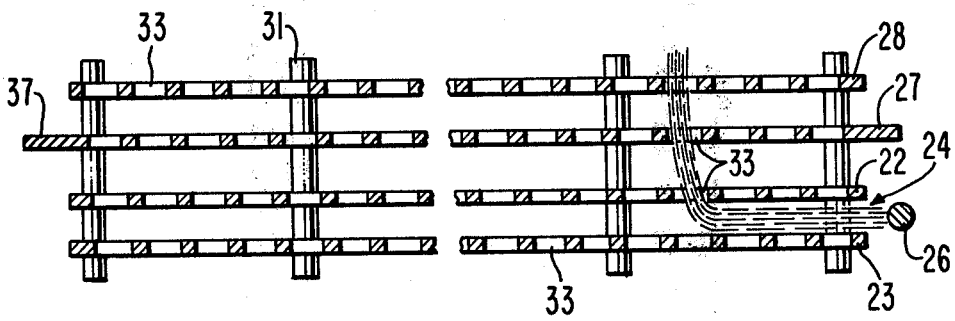

FIG. 3 is a cross section along line 3—3 of FIG. 2.

DETAILED DESCRIPTION OF THE PREFERRED EMBODIMENT

Figure 1:
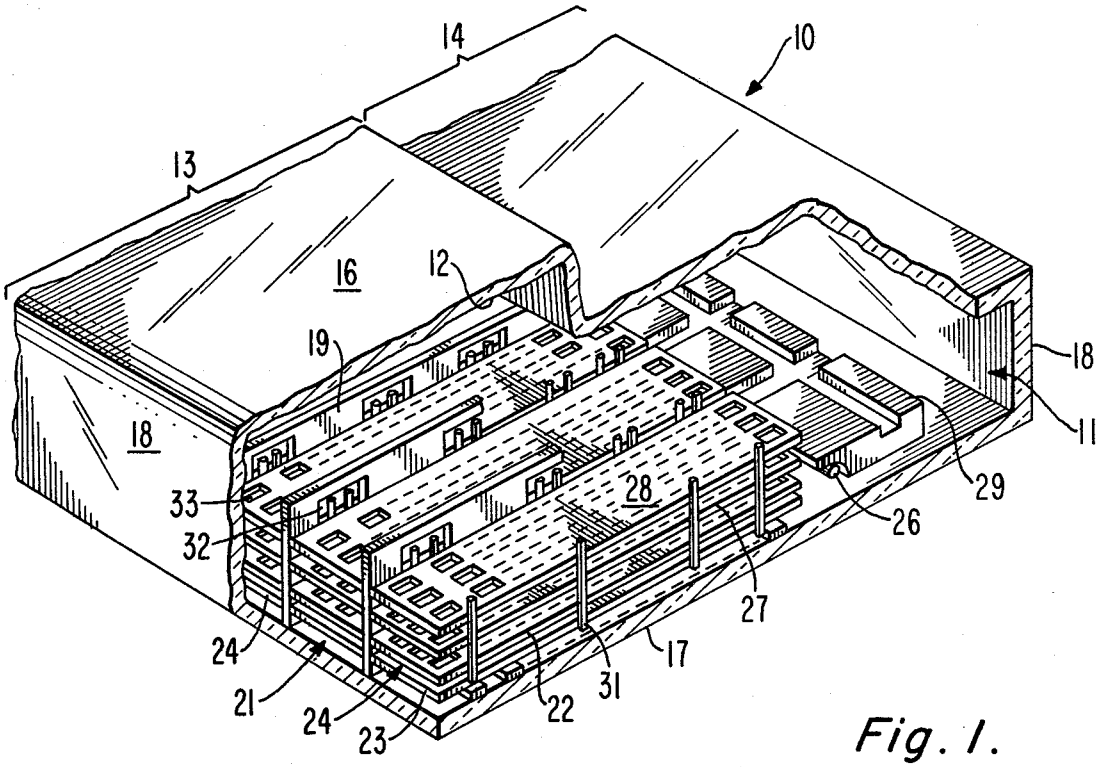
FIG. 1 is a perspective view, partially broken away, of a flat panel display device incorporating the preferred embodiment.

FIG. 1 shows a flat panel display device 10 which incorporates the preferred embodiment. The display device 10 includes an evacuated envelope 11 having a display section 13 and an electron gun section 14. The envelope 11 includes a front wall 16 and a baseplate 17 retained in a spaced parallel relationship by four sidewalls 18. A display screen 12 is positioned along the front wall 16 and gives a visual output when struck by electrons.

A plurality of spaced parallel support vanes 19 are positioned between the front wall 16 and the baseplate 17 and extend substantially from the gun section 14 to the opposite sidewall 18. The support vanes 19 provide the desired internal support against external atmospheric pressure and divide the envelope 11 into a plurality of channels 21. Extending transversely across, and longitudinally along each of the channels, is a pair of spaced parallel beam guide meshes 22 and 23. A cathode 26 is arranged to emit electrons into the spaces 24 between the guide mesh pairs so that the electrons propagate the lengths of the channels. A focus mesh 27 and an acceleration mesh 28 are arranged between the beam guide 22 and the display screen 12. A modulator support 29 extends the transverse dimension of the envelope 11 and supports the meshes 22, 23, 27 and 28 against the longitudinal and transverse movement with respect to the modulator support 29 and the cathode 26.

The meshes 22, 23, 27 and 28 contain apertures 33 which are arranged in columns longitudinally along the meshes and in rows transversely across the meshes. Each column of apertures serves as a beam guide so that three electron beams are propagated along each of the channels 21. When it is desired to print one line of the visual display, the electrons are ejected from the spaces 24 through a transverse row of the apertures 33 so that each of the channels 21 contributes a segment of the full line. For this reason it is essential that the transverse rows of apertures of all channels are aligned across the display screen. Also, in order to realize a uniform brightness of every segment of the visual display, it is necessary for the spacings between the meshes 22, 23, 27 and 28 in all of the channels to be the same within very close tolerances, for example, one mil (0.00254 cm). It is also important for these spacings to remain constant during the operation and handling of the display device. The ability to accurately produce the display device, and all components using automatic or mass assembly techniques, is also important. These advantages can be realized by incorporating the meshes 22, 23, 27 and 28 into a separately constructed beam guide assembly which is assembled onto the baseplate 17 as a complete unit.

In each of the beam guide assemblies the guide meshes 22 and 23, the focus mesh 27 and the acceleration mesh 28 are held in a spaced parallel relationship by insulative supports, or beads, 31 which are described in detail hereinafter. The vanes 19 may include apertures 32 which receive the beads 31. The apertures 32 have a dimension in the longitudinal direction of the channels such that each aperture receives two of the beads 31. The two beads received by each aperture 32 are associated with different, but adjacent, beam guide assemblies. This allows maximum transverse spacing of the beads 31 from the columns of apertures 33 in the meshes 22, 23, 27 and 28 to minimize the effect of the beads on the electrical characteristics of the beam guide assembly.

FIG. 2 shows the preferred embodiment in greater detail. The insulative support beads 31 are substantially equally spaced in columns along the two sides of the mesh assemblies. However, the beads within the two columns are displaced with respect to the transverse rows of apertures 33. Accordingly, two of the beam guide assemblies can be closely positioned adjacent one another with the transverse rows of the apertures 33 in adjacent assemblies in precise alignment. The transverse displacement also permits the beads of adjacent beam guide assemblies to be closely positioned along a line parallel to the longitudinal axis of the meshes so that the beads of adjacent guide assemblies are received by one of the apertures 32 in the vanes 19, as shown in FIG. 1.

Figure 2A:
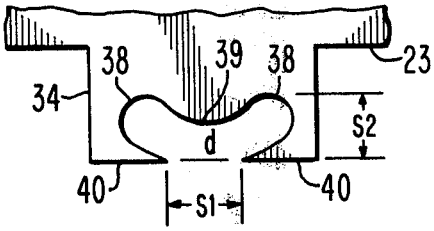

The meshes 22, 23, 27 and 28 include tabs 34 extending outwardly from the edges. These tabs are permanently held by the beads 31 and hold the meshes in the desired spaced relationships and orientations. The tabs 34 are integral with the meshes and thus are precisely located during fabrication of the meshes. Because the beads 31 are affixed to the tabs 34, the positioning of the beads is precisely determined during the fabrication of the meshes. In FIG. 2 one bead, 31*a*, is partially broken away to more clearly show the tab 34 on the mesh 23. All the tabs on all the meshes are similarly configured. FIG. 2*a* shows, in detail, the manner in which the tabs 34 are held by the beads 31. An opening 41 having an entrance $s_1$ is centered on the end of the tab and diverges toward the sides of the tab to form two curved areas 38. A curved deflector 39 connects the curved areas 38 along a continuously curved line so that the opening 41 has a configuration which is similar to a longitudinally divided figured 8, to form a space "d", which is less than the distance $s_2$. The beads 31 are made of a material such as glass and typically of type 7761 glass available from Corning Glass, which becomes malleable when heated. Prior to heating the glass beads have a rectangular cross section with dimensions slightly greater than the distances $s_1$ and $s_2$ of FIG. 2*a*. The beads are heated until malleable and pushed onto the tabs 34. When the malleable bead pushes against the deflector 39 the glass is pushed sideways to fill the curved areas 38. When the glass cools the bead fills the curved areas 38 and the pointed portions 40 hold the tab onto the formed bead.

If desired, the tabs 34 can be eliminated to decrease the total transverse dimension of the beam guide assembly. In this instance the openings 41 are formed in the meshes 22, 23, 27 and 28 along both edges. The beam guide assemblies and the beads 31 can then be positioned between the vanes 19 (FIG. 1) and the apertures 32 eliminated. The desirability of eliminating the tabs is primarily dependent upon the effect the beads have on the operational characteristics of the beam guide assemblies, and this effect is primarily dependent upon the transverse dimension of the meshes and the number of electron beams to be propagated along the assembly.

The focus mesh 27 includes two support tabs 36 and 37. The support tab 36 is received by the modulator support 29 (FIG. 1) to support the guide mesh assemblies against transverse and longitudinal movement with respect to the cathode 26 and the modulator support 29. This retains a permanent spacing between the cathode 26 and the guide mesh assembly and allows for accurate injection of electrons into the space 24 between the guide meshes 22 and 23. The support 37 is received by another support (not shown) to support the other end of the beam guide assemblies against transverse motion.

The meshes 22, 23, 27 and 28 are held in a spaced relationship such that the columns of apertures 33 in the meshes are in alignment in a direction parallel to the longitudinal axis of the beads 31. As shown in FIG. 3, the meshes 22, 27 and 28 are arranged so that the transverse rows of apertures 33 are displaced in the longitudinal direction. The electrons propagate in the space 24 between the meshes 22 and 23 in a direction parallel to the longitudinal axis of the guide mesh assembly. When electrons are ejected from the space 24 toward the screen 12, the velocity component in the longitudinal direction causes the electron beams to follow a curved path. In order to maximize the number of electrons which passes through the apertures 33 in all meshes, the meshes 22, 27 and 28 are arranged so that the transverse rows of apertures are displaced to lie along the curved path of the electrons. The transverse rows of apertures in the guide meshes 22 and 23 are aligned so that the electrons are focused in the space 24.

The instant beam guide assembly can be produced using automatic fabrication and mass production techniques. The meshes 22, 23, 27 and 28 can be etched, stamped or otherwise made as separate units. The meshes are then held in the desired spaced relationship and the beads 31 applied as described above. The malleable glass beads typically will expand when heated. Accordingly, initially the meshes will be spaced slightly further apart than the desired final spacing. The heated beads are then applied to the tabs 34 and upon cooling contract and the meshes are permanently held in a parallel relationship and accurately spaced. The beads are made with the desired length and are applied to the tabs so that the bottoms of the beads uniformly extend beyond the mesh 23. The beaded guide beam assemblies, therefore, are spaced a uniform distance above the baseplate 17 when the bead guide assemblies are assembled onto the baseplate without the need for expensive machining operation. The beam guide assemblies produced in the manner described can then be assembled to the baseplate 17 using automatic assembly techniques.

As shown, the meshes 22, 23, 27 and 28 are planar with flat edges. The meshes are made of thin material and thus are physically fragile. An increase in the physical strength can be realized by forming the meshes into a channel shaped configuration. Alternatively, the guide meshes 22 and 23 can be made into a box-like structure from a single piece of material to enhance the strength of the structure.

What is claimed is:

1. An electron beam guide assembly for a flat panel display device having a frontwall, a baseplate and a plurality of electron beam propagation channels comprising:

a plurality of meshes having apertures arranged longitudinally in columns and transversely in rows; said meshes being arranged in a spaced parallel relationship, and a plurality of elongated insulating support rod means spaced along the length of both longitudinal edges of said meshes, said elongated support means spanning said meshes and extending uniformly beyond at least one of said meshes and being dimensioned to a desired length so that the beam guide assemblies of all of said channels are spaced a uniform distance above said baseplate, said guide meshes being permanently held by said insulating support means to retain said spaced parallel relationship and to retain the longitudinal positions of said rows of apertures.

2. The assembly of claim 1 wherein said support means are glass beads.

3. The assembly of claim 1 wherein said support means are substantially equally spaced along both longitudinal edges of said meshes and are transversely displaced.

4. The assembly of claim 3 wherein said meshes include tabs extending transversely from said meshes, and wherein said support means engage said tabs so that said support means are outside the longitudinal edges of said meshes.

5. The assembly of claim 4 wherein said support means are glass beads.

6. The assembly of claim 5 wherein the ends of said tabs include an opening configured similarly to a longitudinally split figure 8.

7. The assembly of claim 2 wherein said meshes include openings spaced along both edges, said openings being configured similarly to a longitudinally split figure 8.

8. The assembly of claim 3 or 5 or 7, wherein said rows of apertures in at least some of said meshes are longitudinally displaced.

* * * * *